US008477170B2

(12) United States Patent
Tsuchiya

(10) Patent No.: US 8,477,170 B2
(45) Date of Patent: Jul. 2, 2013

(54) IMAGE FORMING APPARATUS WITH SHARED LINE FOR HORIZONTAL SYNCHRONIZATION SIGNAL

(75) Inventor: Toshikazu Tsuchiya, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 830 days.

(21) Appl. No.: 12/619,662

(22) Filed: Nov. 16, 2009

(65) Prior Publication Data

US 2010/0123931 A1 May 20, 2010

(30) Foreign Application Priority Data

Nov. 20, 2008 (JP) ..... 2008-296929

(51) Int. Cl.
*B41J 2/435* (2006.01)
*B41J 2/47* (2006.01)

(52) U.S. Cl.
USPC ..... 347/237; 347/247

(58) Field of Classification Search
USPC ..... 347/230, 234, 235, 229, 237, 247–250
See application file for complete search history.

(56) References Cited

U.S. PATENT DOCUMENTS 5,373,518 A 12/1994 Uchiyama et al. ..... 372/38
5,519,431 A 5/1996 Kusano et al. ..... 347/247

FOREIGN PATENT DOCUMENTS

JP 04-068759 3/1992
JP 04-247760 9/1992
JP 05-153341 6/1993
JP 06-166207 6/1994
JP 10-224531 8/1998
JP 11-334183 12/1999
JP 2000-316076 11/2000
JP 2003-005610 1/2003
JP 2005-217999 8/2005
JP 2006-010825 1/2006
JP 2008269074 A * 11/2008

* cited by examiner

*Primary Examiner* — Hai C Pham
(74) *Attorney, Agent, or Firm* — Fitzpatrick, Cella, Harper & Scinto

(57) ABSTRACT

The image forming apparatus includes a video controller unit that receives image information to convert the image information into an image signal for image formation, an engine controller unit that controls image formation, a laser driver unit that emits a laser beam, and a plurality of signal lines that connect the video controller unit, the engine controller unit, and the laser driver unit to each other, wherein the laser driver unit detects the laser beam emitted from the illumination element and generates a horizontal synchronization signal which is electrically transmitted via any one of the plurality of signal lines and used as the reference of an image writing timing in response to the detection. Among the signal lines, a signal line for transmitting the image signal or a control signal electrically and a signal line for electrically transmitting the horizontal synchronization signal are used as a common signal line.

8 Claims, 9 Drawing Sheets

IMAGE FORMING APPARATUS WITH SHARED LINE FOR HORIZONTAL SYNCHRONIZATION SIGNAL

BACKGROUND OF THE INVENTION

1. Field of the Invention

The present invention relates to an image forming apparatus that uses an electro-photographic process, and more particularly, to a technique for transmitting a horizontal synchronization signal used for the electro-photographic process.

2. Description of the Related Art

FIG. 13 illustrates a circuit diagram of an input/output interface between a laser illumination signal (image signal) and a horizontal synchronization signal (hereinafter sometimes referred to as "BD signal") according to a related art. The laser illumination signal (image signal) and the horizontal synchronization signal (BD signal) are typically connected to individual signal 0lines, and the construction is discussed in Japanese Patent Application Laid-Open No. 2000-316076, for example.

A video controller 440 performs a role of receiving image information from a host computer to convert the image information into an image signal (VDO1). The video controller 440 includes a buffer 105 that receives a BD signal, a pull-up resistor 139, and a driver 101 that converts the image signal (VDO1) into a differential signal. The video controller 440 also includes output impedance matching resistors 131 and 132 and a connector 151.

A laser driver board 120 functions as a laser driver unit that emits a laser beam. The laser driver board 120 includes a laser driver 111 that drives a semiconductor laser 421, a receiver 102 that receives differential video signals (VD1 and /VD1) as input, an input impedance matching resistor 135, a BD IC 113 that functions as a horizontal synchronization signal detector, a protection resistor 137, and a connector 209. Here, the symbol "/" represents a negative logic (low-active).

A DC controller 201 is a control unit of a printer engine. The printer engine includes various elements for forming color images which will be described in detail later with reference to FIG. 2.

The DC controller 201 has connectors 152 and 210 that link the video controller 440 and the laser driver board 120 together. A flexible flat cable (FFC) 211 is used for connecting the DC controller 201 and the laser driver board 120. The connectors 151 and 152 are general board-to-board connectors which are compliant with the DIN standards (IEC603-2/DIN41612 standards).

FIG. 14 illustrates a timing chart of the circuit diagram of FIG. 13.

The BD signal (/BD1) used as the horizontal synchronization signal has a negative logic and becomes a low level "L" when a laser beam L is being irradiated to a BD sensor 160. In the drawing, VD1 and /VD1 respectively represent positive and negative logic outputs of the driver 101. Both of the outputs have the lowest voltage level of 0.77 V for "L" and the highest voltage level of 1.77 V for "H". When the BD signal (/BD1) used as the horizontal synchronization signal becomes "L", the video controller 440 outputs the image signal (VDO1) at an image area after a predetermined period. Thereafter, by the known electro-photographic process, images are developed on a photosensitive drum and transferred to recording sheet.

The recording sheet is subsequently heated and pressurized so that the images are fixed.

In practice, in addition to the elements illustrated in FIG. 13, the laser driver board 120 includes a signal line for supplying electrical power to each part thereof. In addition, the laser driver board 120 includes a signal line for transmitting a command that causes the semiconductor laser 421 to illuminate laser light compulsorily in order to detect the BD signal and a PWM signal line for controlling the emission time of the semiconductor laser 421. Such signal lines are not depicted for the sake of clarity.

In the case of a color laser printer, such signal lines must be provided for each color of yellow (Y), magenta (M), cyan (C), and black (B). That is to say, signal lines for the BD signals of each color which are output from the laser driver board 120 and input to the video controller 440 must be provided between the video controller 440 and the laser driver board 120. Moreover, signal lines for the differential video signals of each color which are output from the video controller 440 and input to the laser driver board 120 must be provided between them. Therefore, four times signal lines of three signal lines illustrated in FIG. 13 are necessary, namely, twelve signal lines are required in total.

Particularly, when the ends of signal lines are configured by connectors, the connectors need to have a size corresponding with the number of signal lines, which leads to an increase in the connector costs.

Therefore, it is desirable to reduce the number of signal lines without sacrificing the functions related to the horizontal synchronization signal.

SUMMARY OF THE INVENTION

According to an aspect of the present invention, there is provided an image forming apparatus that can reduce the number of signal lines without sacrificing the functions related to the horizontal synchronization signal.

A purpose of the invention is to provide an image forming apparatus including a laser driver unit that makes an illumination element emit a laser beam according to an input image signal; a controller unit that controls the laser driver unit; and a plurality of signal lines that connect the laser driver unit and the controller unit to each other so that an image signal and a control signal are output from the controller unit to the laser driver unit via any one of the plurality of signal lines, wherein the laser driver unit includes a laser beam detector that detects a laser beam emitted from the illumination element; and a horizontal synchronization signal generator that generates a horizontal synchronization signal which is electrically transmitted to the controller unit via any one of the plurality of signal lines and used as the reference of an image writing timing in response to detection of the laser beam detector. Among the plurality of signal lines, a signal line for electrically transmitting the image signal or the control signal and a signal line for electrically transmitting the horizontal synchronization signal are configured to be used as a common signal line.

Further features and aspects of the present invention will become apparent from the following detailed description of exemplary embodiments with reference to the attached drawings.

DESCRIPTION OF THE EMBODIMENTS

Exemplary embodiments of the present invention will now be illustrated. The individual embodiments described below will be helpful in understanding a variety of concepts of the present invention from the generic to the more specific. Further, the technical scope of the present invention is defined by the claims, and is not limited by the following individual embodiments. The detailed description of the exemplary embodiments of the present invention will be provided by way of an example of a color laser printer.

<Printer Construction Diagram>

Figure 2:
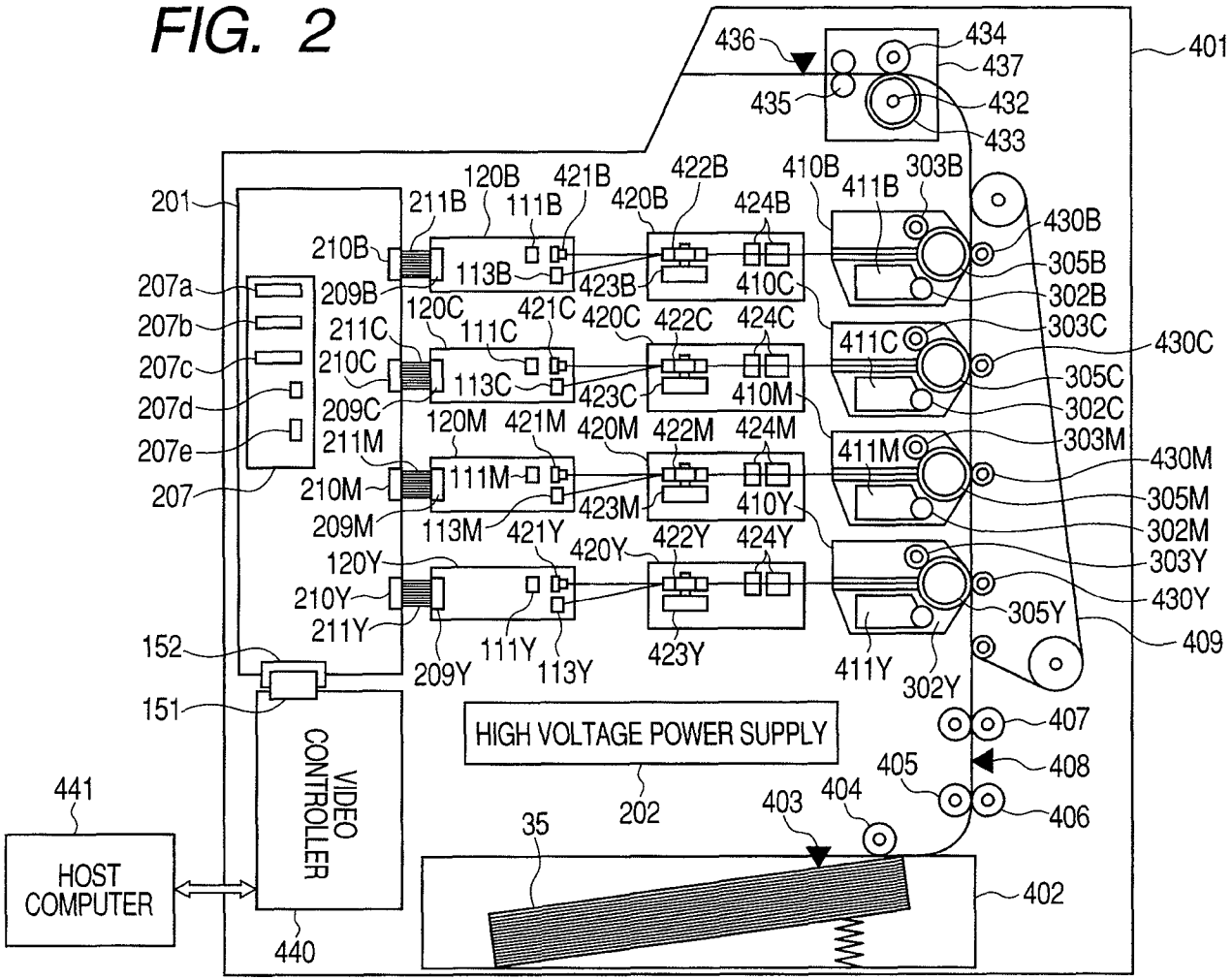
FIG. 2 is a sectional view illustrating an embodiment of the construction of a color laser printer.

FIG. 2 is a construction diagram of a "color laser printer" according to a first embodiment.

As illustrated in FIG. 2, the color laser printer includes a color laser printer body 401, a deck 402 which stores a recording sheet 35, and a deck sheet presence/absence sensor 403 which detects the presence/absence of the recording sheet 35 in the deck 402. The color laser printer also includes a pickup roller 404 which picks up the recording sheet 35 from the deck 402, and a deck sheet feed roller 405 which conveys the recording sheet 35 picked up by the pickup roller 404. The color laser printer further includes a retard roller 406 which is paired with the deck sheet feed roller 405 so as to prevent multi-feed of the recording sheet 35. A registration roller pair 407 which synchronously conveys the recording sheet 35, and a pre-registration sensor 408 which detects conveyance of the recording sheet 35 to the registration roller pair 407 are arranged downstream of the deck sheet feed roller 405.

An ETB unit which includes electrostatic adsorption/conveyance/transfer belt (hereinafter referred to as "ETB") 409 is arranged downstream of the registration roller pair 407. A color image formed by toner images of the four colors Y (yellow), M (magenta), C (cyan), and B (black) is formed on the ETB 409 by the following process. That is, images formed by image forming units comprised of process cartridges 410 (Y, M, C, and B) and scanner units 420 (Y, M, C, and B) for the four colors Y, M, C, and B are sequentially superposed on each other by transfer rollers 430 (Y, M, C, and B). In this way, a color image is formed and is subsequently transferred onto the recording sheet 35. The recording sheet 35 having the color image formed thereon is conveyed downstream to a fixing unit 437 where the toner images transferred onto the recording sheet 35 are fixed by heat. The fixing unit 437 includes a pair of a pressure roller 434 and a fixing roller 433 which incorporates therein a heater 432, and a fixing/discharge roller pair 435 which conveys the recording sheet 35 from the fixing roller 433. Moreover, a fixing/discharge sensor 436 is arranged so as to detect conveyance of the recording sheet 35 from the fixing unit 437.

Each scanner unit 420 includes a semiconductor laser 421 that functions as an illumination element, a rotating polygon mirror 422, a scanner motor 423, and an Fθ lens (imaging lens group) 424. The semiconductor laser 421 emits a laser beam that is modulated based on image signals delivered (supplied) from a video controller 440. The rotating polygon mirror 422 and the scanner motor 423 are configured to scan the laser beam from the semiconductor laser 421 onto respective photosensitive drums 305.

Each process cartridge 410 includes the photosensitive drum 305, a non-illustrated charging high-voltage transformer board mounting thereon a charging roller 303, a piezoelectric high-voltage transformer and a rectification element, a developing roller 302, and a toner storage container 411 which are necessary for the known electrophotographic process. The process cartridge 410 is configured to be detachable from the color laser printer body 401. Upon receiving image signal delivered from an external device 441 such as a host computer, the video controller 440 converts the image signal into bitmap data to generate an image signal for image formation.

Moreover, a DC controller 201 is provided as a control unit of the laser printer body 401 (printer engine). In this specification, the DC controller 201 is referred to as an engine controller, and is sometimes referred to as a second controller unit whereas the video controller 440 is referred to as a first controller unit. The DC controller 201 includes a one-chip microcomputer (hereinafter referred to as a CPU) 207 which is provided with a RAM 207*a*, a ROM 207*b*, a timer 207*c*, a digital input/output port 207*d*, and a D/A port 207*e*. The control procedures of the CPU 207 are stored in the ROM 207*b*. The DC controller 201 also includes a nonvolatile storage device (EEPROM) and various input/output control circuits (not illustrated). A high voltage power supply (piezoelectric transformer type high voltage power supply) 202 includes a control unit of a charging high-voltage power supply (not illustrated) and a development high-voltage power supply (not illustrated) which correspond to each of the process cartridges 410 (Y, M, C, and B). The high voltage power supply 202 also includes a transfer high-voltage power supply which uses a piezoelectric transformer capable of outputting a high voltage corresponding to each of the transfer rollers 430 (Y, M, C, and B).

<Diagram Describing Scanning Optical Unit>

Figure 3:
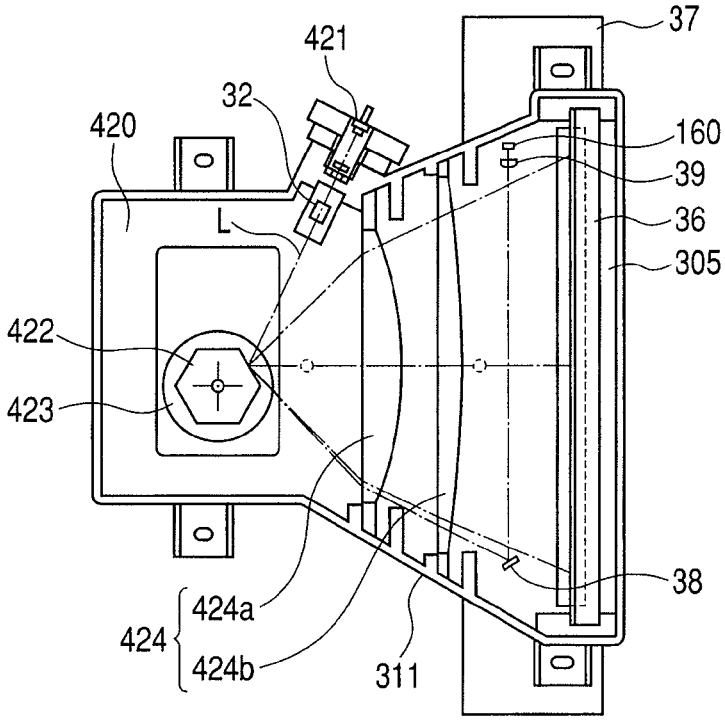
FIG. 3 is a construction diagram illustrating an embodiment of a scanning optical unit.

Description of a typical scanning optical unit which is used for an image forming apparatus such as a laser beam printer or a laser facsimile and includes optical members will be provided with reference to FIG. 3.

The scanning optical unit includes a semiconductor laser 421 that generates a laser beam L, a cylindrical lens 32, a rotating polygon mirror (also referred to as a polygon mirror) 422, and a deflecting scanning unit (hereinafter referred to as a scanner motor) 423 that rotates the rotating polygon mirror 422. The cylindrical lens 32, the rotating polygon mirror 422, and the scanner motor 423 are arranged in that order on the optical path of the laser beam emitted from the semiconductor laser 421. Moreover, an Fθ lens 424, a folding mirror 36, and the photosensitive drum 305 are arranged on the optical path of the laser beam L reflected from the rotating polygon mirror 422. Moreover, a signal detection mirror 38 is arranged so as to reflect part of the laser beam L that is deflected to scan areas of the photosensitive drum 305 outside an effective image area thereof. Furthermore, an imaging lens 39 and a laser beam detection sensor (sometimes referred to as a BD sensor or a laser beam detector) 160 are arranged on the optical path of the laser beam L reflected from the signal detection mirror 38.

The output (BD signal) of the BD sensor 160 is used as a horizontal synchronization signal which is the reference signal (reference) of the main-scanning of the laser beam L. The BD signal is used as the reference signal of an image writing timing at which the laser driver 111 drives the semiconductor laser 421 to emit a laser beam in the main-scanning direction.

The described optical members are accommodated in a space which is hermetically sealed by an optical box 311 and a cover (not illustrated).

The laser beam L generated by the semiconductor laser 421 is imaged as a linear image on the rotating polygon mirror 422 by the cylindrical lens 32. The laser beam L is subsequently deflected from the rotating polygon mirror 422 by the scanner motor 423 rotating the rotating polygon mirror 422. The deflected laser beam L passes through the Fθ lens 424 and reflects from the folding mirror 36 to be imaged and scanned onto the photosensitive drum 305.

The Fθ lens 424 is configured to condense the light beams reflecting from the rotating polygon mirror 422 so as to form a spot image on the photosensitive drum 305.

The photosensitive drum 305 rotates around the axial line of its cylinder, whereby sub-scanning is performed. In this way, electrostatic latent images are formed on the surface of the photosensitive drum 305.

<Circuit Diagram of Input/Output Interface Between Laser Illumination Signal (Image Signal) and Horizontal Synchronization Signal (BD Signal)>

The description of a circuit construction of a main part of the present embodiment will be provided below.

Figure 1:
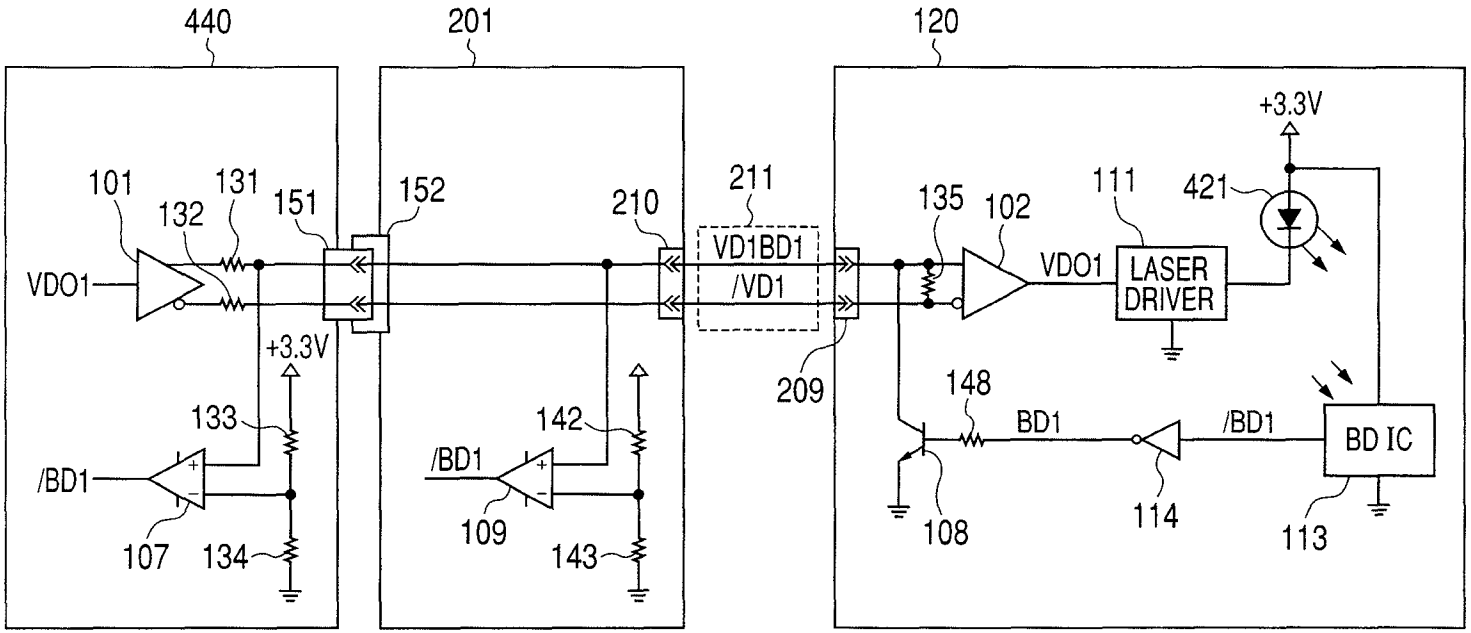
FIG. 1 illustrates an embodiment of a circuit diagram of an input/output interface between a laser illumination signal (image signal) and a horizontal synchronization signal (BD signal).

FIG. 1 is a circuit diagram of an input/output interface between a laser illumination signal (image signal) and a horizontal synchronization signal (BD signal) according to the present embodiment. Components such as, for example, transistors, resistors, and operational amplifiers mounted on each board, excluding connectors, the BD IC 113, the laser driver 111, and the semiconductor laser 421, may be integrated into an integrated circuit.

Figure 13:
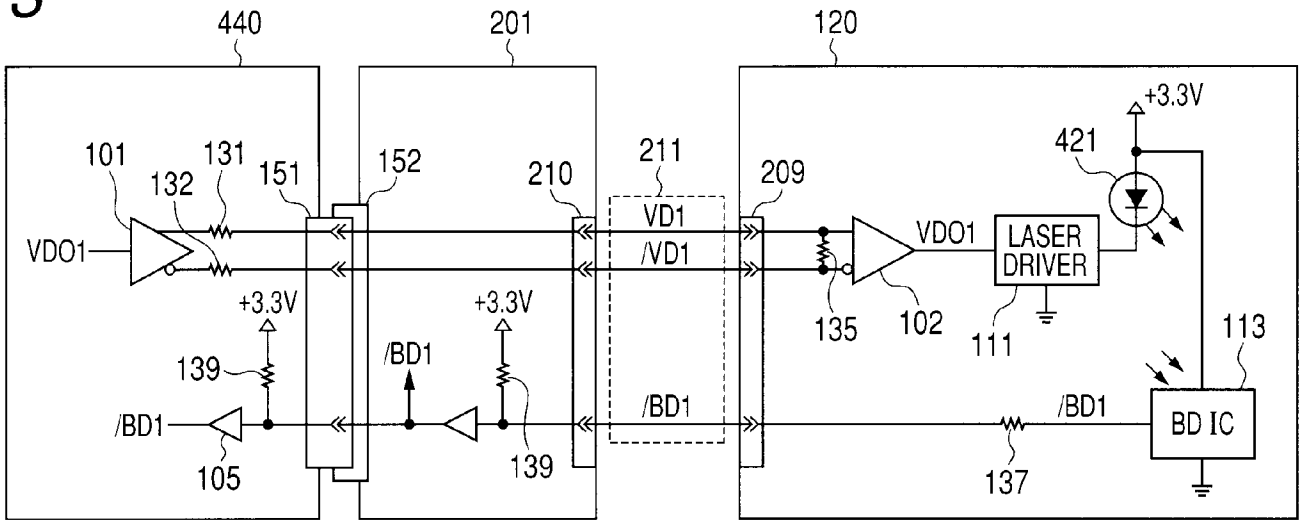
FIG. 13 (PRIOR ART)
FIG. 13 illustrates a circuit diagram of an input/output interface between a laser illumination signal (image signal) and a horizontal synchronization signal (BD signal) according to a related art.
Figure 14:
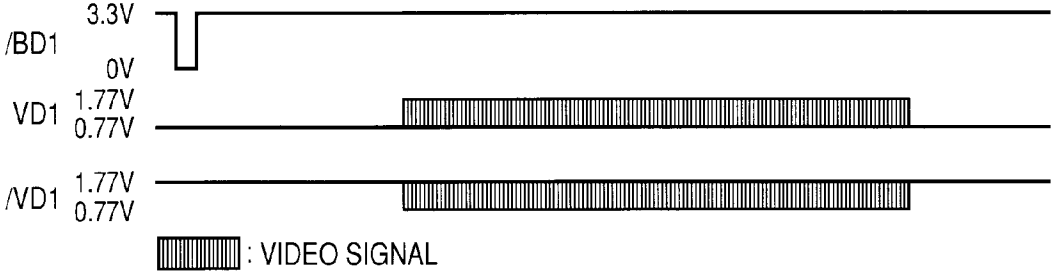
FIG. 14 (PRIOR ART)
FIG. 14 is a timing chart illustrating the relationship between the image signal and the BD signal according to the related art.

The circuit diagram of FIG. 1 is different from the circuit diagram of the related art illustrated in FIG. 13, in that the BD signal is communicated through the positive logic-side signal line of the differential video signal.

Referring to FIG. 1, a video controller 440 is configured to receive image information from a host computer to convert the image information into an image signal (VDO1). The video controller 440 includes a comparator 107 that receives a BD signal, and a driver 101 that functions as an image signal output portion that converts and outputs the image signal (VDO1) into a differential signal. The video controller 440 also includes output impedance matching resistors 131 and 132 and a connector 151. The output impedance matching resistors 131 and 132 are configured to achieve impedance matching between the output impedance of the driver 101, the input impedance of a receiver 102, and the impedance of a signal line for transmitting the image signal therethrough. The output impedance matching resistor 131 is disposed between the driver 101 used as the image signal output portion and a signal line are configured to be used as a common signal line.

A laser driver board 120 functions as a laser driver unit for emitting a laser beam with an illumination element. The laser driver board 120 includes a laser driver 111 that drives a semiconductor laser element 421 as the illumination element, a receiver 102 that receives differential video signals (VD1BD1 and /VD1) as an input, an input impedance matching resistor 135, a BD IC 113 that functions as a horizontal synchronization signal detector, an inverter 114, and a connector 209. Here, the symbol "/" represents a negative logic (low-active).

A DC controller 201 is a control unit of the laser beam printer.

The DC controller 201 has connectors 152 and 210 that connect the DC controller 201 to the video controller 440 and the laser driver board 120, respectively. A flexible flat cable (FFC) 211 is used for connecting the DC controller 201 and the laser driver board 120. The connectors 151 and 152 are general board-to-board connectors which are compliant with the DIN standards (IEC603-2/DIN41612 standards).

The flexible flat cable (FFC) 211 is comprised of a plurality of signal lines having respective ends thereof configured as the connectors 210 and 209. The image signal and a control signal are transmitted via any one of the plurality of signal lines. More specifically, the FFC 211 is comprised of a plurality of signal lines such as, for example, a VD1BD1 line, a /VD1 line, and a power line. The VD1BD1 signal line is used in common for transmitting both signals VD1 (image signal) and BD1 (BD signal). Therefore, it is possible to reduce the number of signal lines for connecting the video controller unit, the engine controller unit, and the laser driver unit to each other, thus decreasing the costs. Moreover, the reduced number of signal lines enables the connectors to be manufactured in small sizes, which in turn, enables all the related boards to be manufactured in small sizes. Furthermore, since the number of signal patterns being used can be reduced, the degree of freedom in the layout design of the signal patterns can be increased.

The inverter 114 inverts logic signals. A transistor 108 is a PNP-type transistor, and a current-limiting resistor 148 is connected to the base of the transistor 108. The transistor 108 functions as a signal source of the BD signal. The comparator 109 is configured to detect the BD signal.

When the BD signal /BD1 is input, the output of the inverter 114 becomes "H" and the transistor 108 turns ON, whereby the voltage on the signal line transmitting the horizontal synchronization signal is changed to a predetermined value. Specifically, the voltage on the VD1BD1 line is changed from 1.77 V or higher to 0.3 V or lower. A voltage of +3.3 V is divided by fixed resistors 142 and 143 so that a reference voltage of 0.5 V is supplied to the negative terminal of the comparator 109.

When the transistor 108 is turned ON, the output of the comparator 109 becomes a low level "L." The same circuit components, namely a comparator 107 and voltage-dividing resistors 133 and 134 are provided to the video controller 440. The comparator 107 performs the same operation as the comparator 109, and the output of the comparator 107 becomes "L" when the transistor 108 is turned ON.

Although in FIG. 1, the video controller 440 and the DC controller 201 are described as mounted on different boards, the present invention is not limited to such an embodiment. For example, the video controller 440 and the DC controller 201 may be mounted on the same board without discrimination. Moreover, the functions of the video controller 440 and the DC controller 201, other than the laser driver board 120 may be incorporated into the same controller unit.

Moreover, the laser driver board 120 is not limited to an embodiment such as illustrated in FIG. 1, but any of the components included in the laser driver board 120 illustrated in FIG. 1 may be mounted on the other boards. For example, only the BD IC 113 may be mounted on a separate board different from the laser driver board 120 illustrated in FIG. 1. In such a case, the BD IC 113 mounted on the separate board may be included in the laser driver unit.

<Timing Chart Illustrating Relationship Between Image Signal and BD Signal>

Figure 4:
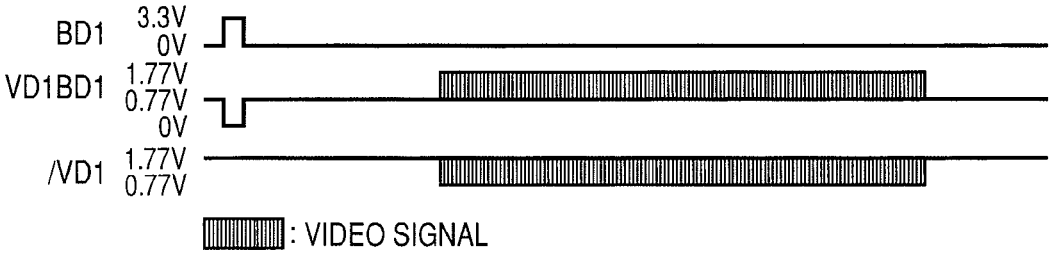
FIG. 4 illustrates an embodiment of a timing chart illustrating the relationship between the image signal and the BD signal.

FIG. 4 is a timing chart illustrating the relationship between the image signal and the BD signal according to the present embodiment. The BD IC 113 functions as a horizontal synchronization signal generator. Upon receiving the laser beam L, the BD IC 113 outputs the horizontal synchronization signal. More specifically, the /BD1 becomes "L" and the BD1 becomes "H" whereby the transistor 108 is turned ON. At that time, the transmission timing of the image signal and the transmission timing of the BD signal do not overlap with each other. When a main-scanning image area is encountered, the video controller 440 transmits the image signal VDO1. The VD1BD1 line and the /VD1 line operate differentially with voltages 0.77 V and 1.77 V, respectively, thus transmitting the image signal to the laser driver 111. When the main-scanning image area is finished, the image signal VDO1 becomes "L" and the image signal /VD1 becomes "H." That is to say, the VD1BD1 line is at the voltage of about 0.77 V, and the /VD1 line is at the voltage of 1.77 V.

<Timing Chart Illustrating Relationship Between Image Signal and BD Signal with Superimposed Noise>

Figure 5:
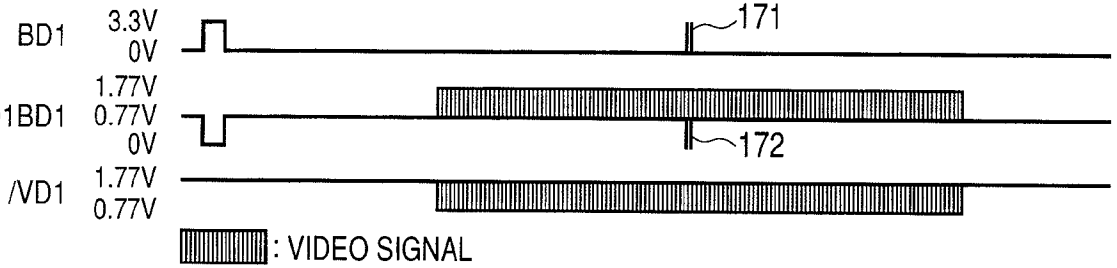
FIG. 5 illustrates an embodiment of a timing chart illustrating the relationship between the image signal and the BD signal in the case of superimposed noise.

FIG. 5 is a timing chart for describing the case where extraneous noise is superimposed on the BD1 line. The noise is depicted by reference numeral 171 or 172. When the transistor 108 is turned ON due to malfunction, the voltage on the VD1BD1 line changes from 1.77 V or higher to 0.3 V or lower whereas the semiconductor laser 421 stops illumination of laser light regardless of the voltage level on the /VD1 line. In this way, even when the horizontal synchronization signal (resulting from the extraneous noise) is transmitted through the VD1BD1 line during the transmission of the image signal therethrough, the image signal is erased and the semiconductor laser 421 stops illumination of laser light. As a result, it is possible to prevent an unfavorable state in which black dots are formed on the white background and thus printing defects are noticed.

Although in FIG. 5, the transistor 108 is exemplified by an NPN-type transistor, the transistor 108 may be an N-channel field effect transistor (Nch-FET).

The described construction and operation according to the present embodiment provide the following advantages. The image signal is communicated using a voltage range of 0.77 V to 1.77 V. On the other hand, the BD signal /BD1 is communicated using two logic states: one is a high impedance (hereinafter referred to as "Hi-Z") condition where no current flows into the collector of the transistor 108 which is connected to the VD1BD1 line; and the other is a state where the collector voltage of the transistor 108 when current flows into the transistor 108 is 0.3 V or lower. In this way, since the voltage range used for the image signal does not overlap with the voltage range used for the horizontal synchronization signal, it is possible to prevent the image signal from being erroneously detected as the BD signal /BD1.

Moreover, even when noise is superimposed on the BD1 line in the image area, the image signal is changed so that the semiconductor laser 421 stops illumination of laser light. Therefore, it is possible to provide an advantage that black dots are rarely noticeable compared to the case where the semiconductor laser 421 continues illumination of laser light and thus forming black dots due to the superimposed noise. Furthermore, since the collector of the transistor 108 is in the "Hi-Z" condition during times other than when the /BD1 signal is being transmitted, the differential signal is not distorted.

The noise superimposed on the BD signal may cause noticeable printing defects. However, according to the present embodiment, even when low-impedance noise is superimposed on the BD signal, since the BD signal is communicated through a differential signal line which operates in a common mode so as to cancel the noise, it is possible to prevent the effects of the superimposed noise compared to the circuit according to the related art.

Moreover, since the fixed resistor 131 (the impedance matching resistor 131 in FIG. 1) functions as an output impedance matching resistor during the transmission of the image signal and functions as a current-limiting resistor during the transmission of the /BD1 signal, it is not necessary to add an additional resistor, thus saving the board space. Furthermore, it is possible to reduce the number of signal lines for connecting the control unit (either one or both of the video controller 440 and the DC controller 201) without sacrificing the functions related to the transmission of the image signal and the BD signal.

There will be substantially no or little increase in the costs when the constructions of semiconductors such as transistors newly added to the construction of the related art are incorporated as modified parts of an ASIC which is a large-scale integrated circuit. Even if the costs increase, such an increase would be far smaller than the costs of the flexible flat cable 211 or the connectors 152 and 210.

Particularly, the DC controller 201 and the laser driver board 120 are often, but not always, positioned far apart from each other. This is because it is necessary to arrange the laser driver 111 (the laser driver board 120) in the vicinity of the semiconductor laser 421, and therefore, it is difficult to integrate the laser driver board 120 and the DC controller 201 together from the layout perspective. Moreover, when the DC controller 201 and the laser driver board 120 are configured as separate units, any malfunctioning unit can be replaced independently. In such a case, although the connectors 209 and 210 and the flexible flat cable (FFC) 211 should be replaced together with the malfunctioning unit, the corresponding unit can be replaced independently, and thus a great reduction in cost can be realized.

The "color laser printer" according to the second embodiment will be described below. The constructions illustrated in FIGS. 2 and 3 described in connection with the first embodiment are applied to the present embodiment. Therefore, detailed description of the redundant constructions will be omitted.

<Circuit Diagram of Input/Output Interface Between Laser Illumination Signal (Image Signal) and Horizontal Synchronization Signal (BD Signal)>

Figure 6:
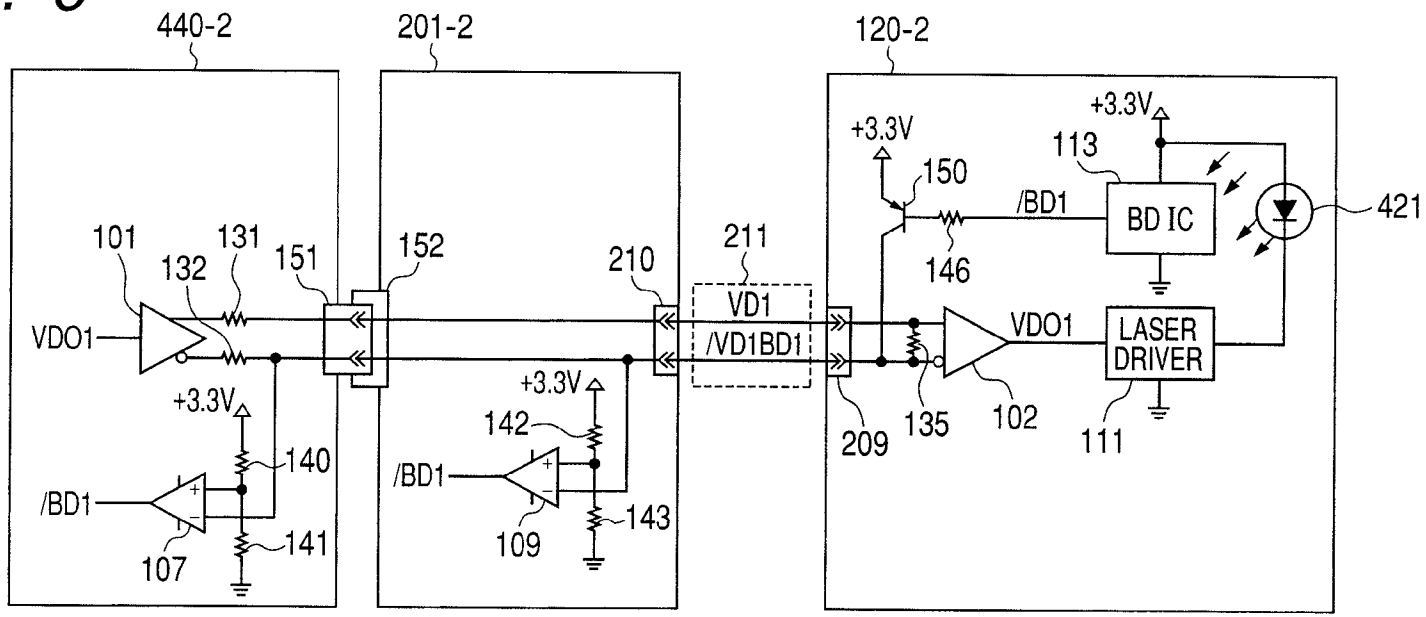
FIG. 6 illustrates another embodiment of the circuit diagram of the input/output interface between the laser illumination signal (image signal) and the horizontal synchronization signal (BD signal).

FIG. 6 is a circuit diagram of an input/output interface between a laser illumination signal (image signal) and a horizontal synchronization signal (BD signal) according to the present embodiment. The circuit diagram of FIG. 6 is different from that of the first embodiment, in that the /BD1 signal is communicated through the low-active-side signal line of the image signal. Other circuit constructions are the same as those of the first embodiment, the description thereof will be referenced therein and no further description will be provided.

Referring to FIG. 6, a PNP-type transistor 150 has an emitter thereof being connected to +3.3 V power source and a collector thereof being connected to the low-active side of an image signal line. A comparator 107 that is configured to detect the /BD1 signal has a positive input terminal thereof being supplied with a voltage of 2.5 V which is obtained by the fixed resistors 140 and 141 dividing the power supply voltage.

When the laser beam L is not received, the output of the BD IC 113 is "H" and the transistor 150 is turned OFF. That is to say, the collector of the PNP-type transistor 150 is in the "Hi-Z" condition. At this time, the state of the /VD1BD1 line depends on the driver 101. On the contrary, when the laser beam L is received by the BD IC 113, the output of the BD IC 113 becomes "L" and the PNP-type transistor 150 is turned ON. Then, the voltage on the /VD1BD1 line becomes 3.0 V or higher, and the output of the comparator 107 becomes "L."

<Timing Chart Illustrating Relationship Between Image Signal and BD Signal with Superimposed Noise>

Figure 7:
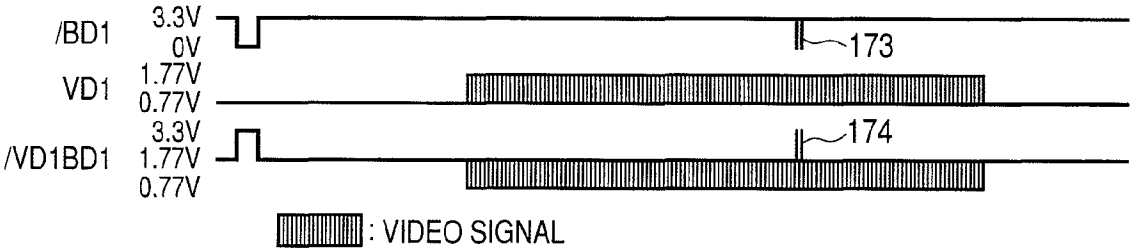
FIG. 7 illustrates another embodiment of the timing chart illustrating the relationship between the image signal and the BD signal in the case of superimposed noise.

FIG. 7 is a timing chart illustrating the relationship between the image signal and the BD signal in the case of superimposed noise according to the present embodiment.

The /VD1BD1 line is at voltages of 0.77 V to 1.77 V when the /BD1 signal is "H". When the /BD1 signal becomes "L", the transistor 150 is turned ON, and the voltage of the emitter thereof rises near 3.3 V. Even when noise as depicted by reference numeral 173 or 174 is superimposed on the /BD1 or BD1 line in the image area, since the semiconductor laser 421 stops illumination of laser light, printing defects will be rarely noticed. Similar to the first embodiment, the voltage range used for the image signal does not overlap with the voltage range used for the BD signal (the horizontal synchronization signal).

As described above, owing to the described construction and operation according to the present embodiment, the number of signal lines for transmitting the /BD1 signal and the image signal can be decreased from 3 in the related art to 2 per color in the interface portion between the video controller, the DC controller, and the laser driver board.

Moreover, the inverter 114 for inverting logic signals which is used in the first embodiment becomes unnecessary. Furthermore, since a BD1EN signal line which is used in a later-described third embodiment need not be provided between the DC controller 201 and the laser driver board 120, having one signal line for each color becomes unnecessary for the connectors 209 and 210 and the FFC 221.

Although in the present embodiment, the transistor 150 is exemplified by a PNP-type transistor, the transistor 150 may be a P-channel field effect transistor (Pch-FET).

The description of the "color laser printer" according to the third embodiment will be provided below. The constructions illustrated in FIGS. 2 and 3 described in connection with the first embodiment are applied to the present embodiment. Therefore, detailed description of the redundant constructions will be omitted.

<Circuit Diagram of Input/Output Interface Between Laser Illumination Signal (Image Signal) and Horizontal Synchronization Signal (BD Signal)>

Figure 8:
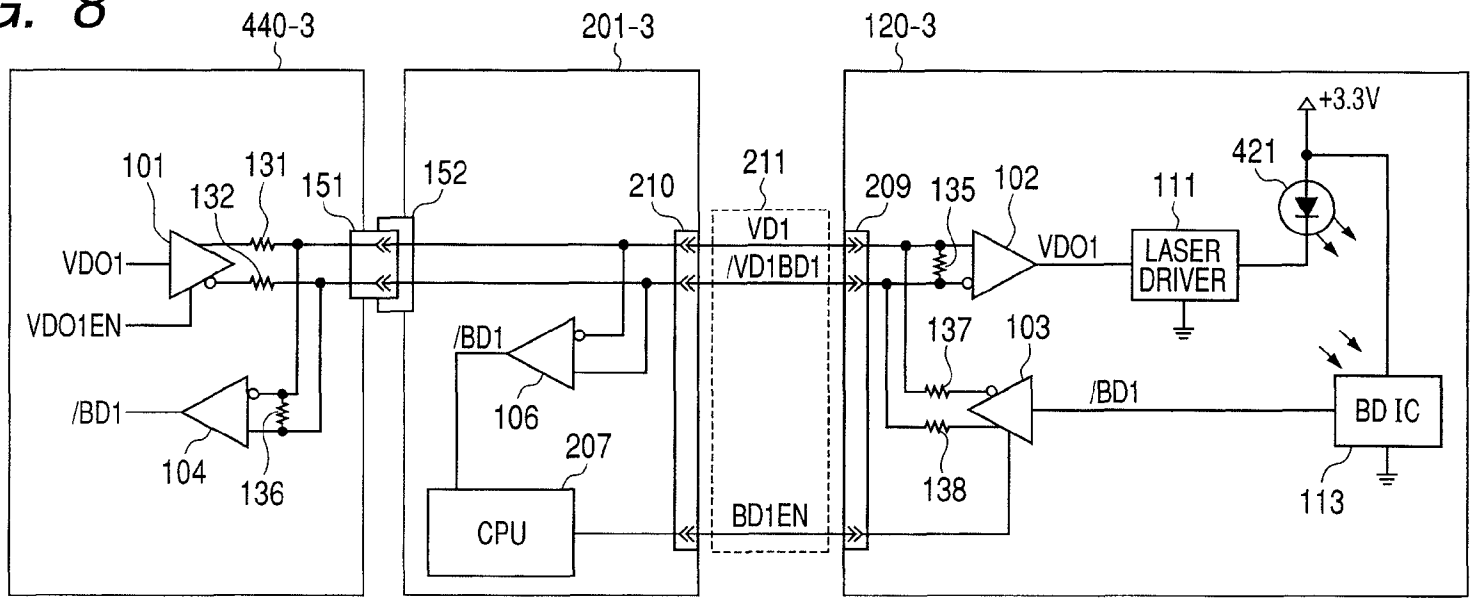
FIG. 8 illustrates another embodiment of the circuit diagram of the input/output interface between the laser illumination signal (image signal) and the horizontal synchronization signal (BD signal).

FIG. 8 is a circuit diagram of an input/output interface between a laser illumination signal (image signal) and a horizontal synchronization signal (BD signal) according to the present embodiment.

The same constructions as those of the related art and the first embodiment will be denoted by the same reference numerals, and thus redundant description thereof will be omitted.

The circuit diagram of FIG. 8 is different from that of the first embodiment, in that the BD signal is transmitted by a driver 103, and a DC controller 201-3 and a video controller 440-3 are provided with BD-exclusive receivers 106 and 104, respectively. Moreover, the drivers 101 and 103 have input terminals which are respectively supplied with enable signals (VDO1EN and BD1EN) for enabling/disabling them. In the disabled state, they are in the "Hi-Z" condition. The BD1EN signal is controlled by a DC controller 201-3. Moreover, in order to communicate the BD1EN signal between the DC controller 201-3 and the laser driver board 120-3, one signal line for each color, four in total for all of the colors, is additionally added for the connectors 209 and 210 and the FFC 211.

Figure 9:
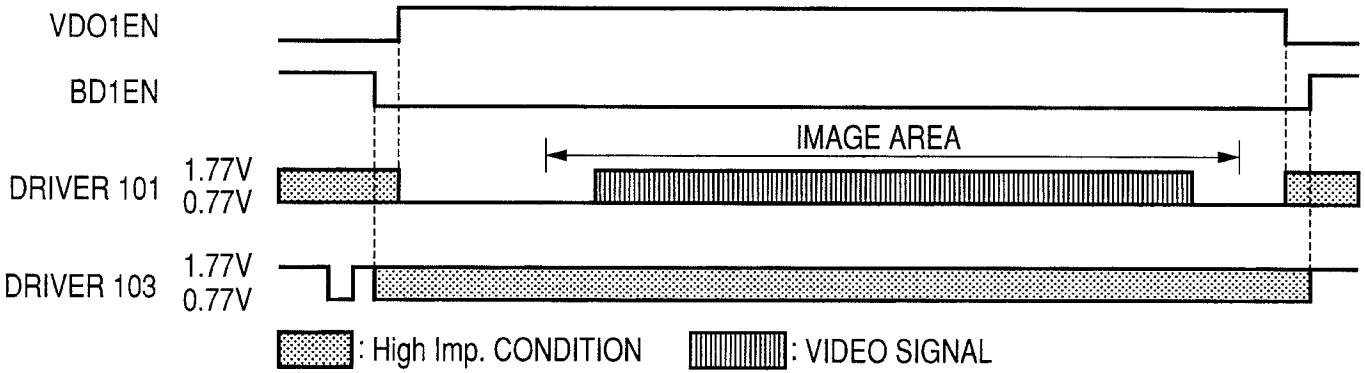
FIG. 9 illustrates another embodiment of the timing chart illustrating the relationship between the image signal and the BD signal.

FIG. 9 is a timing chart illustrating the relationship between the image signal and the BD signal according to the present embodiment. The operation will be described in detail with reference to the corresponding flowchart.

Figure 10:
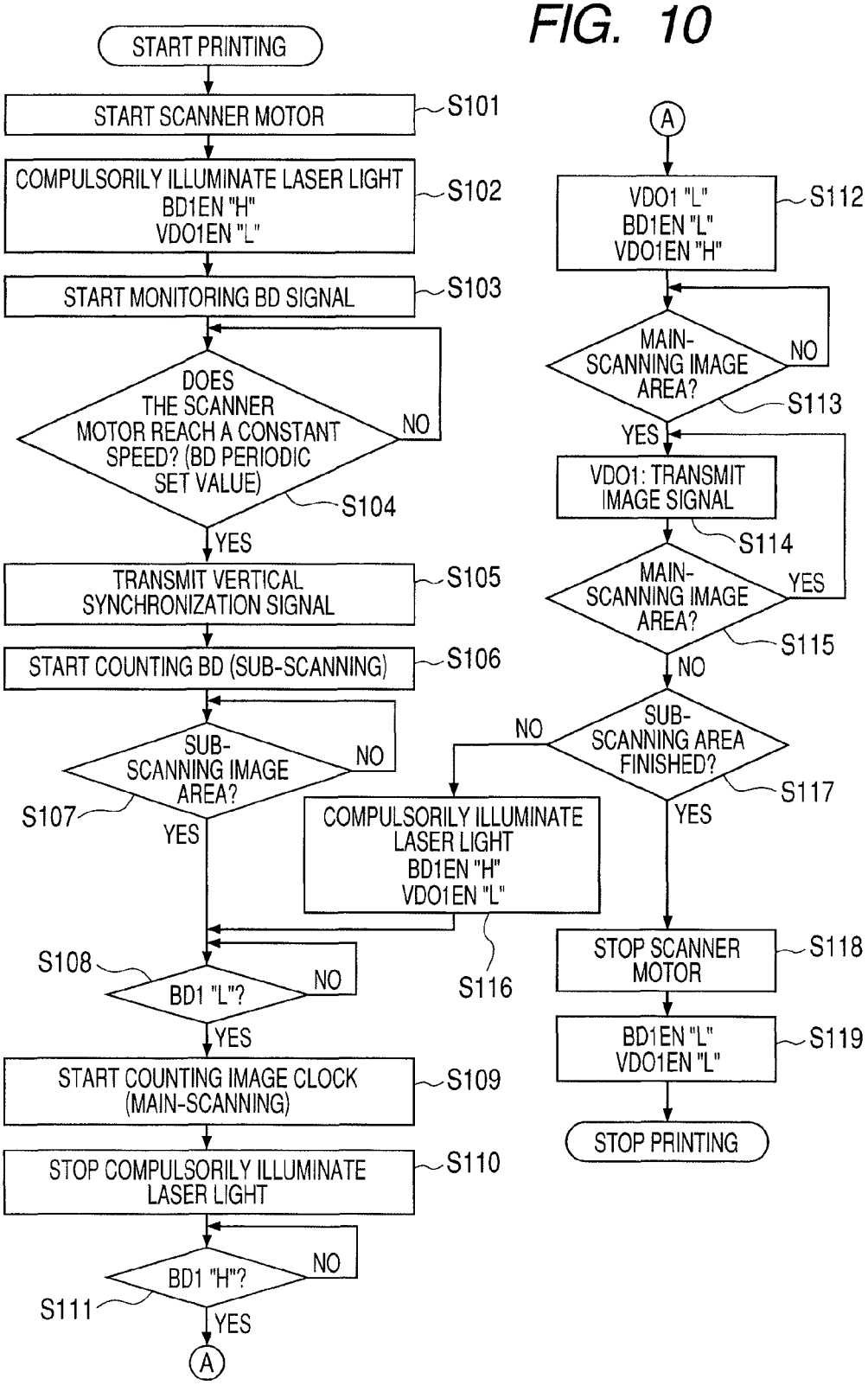
FIG. 10 illustrates an embodiment of a flowchart illustrating the operation of the scanning optical unit.

FIG. 10 is a flowchart according to the present embodiment. Although the steps of this flowchart are performed by the CPU 207, the present invention is not limited to this. For example, when application specific integrated circuits (SAICs) are mounted on the image forming apparatus, the functions of any one of the steps may be performed by the SAICs.

Upon receiving a print start command, the drive of the scanner motor is started (step 101; hereinafter abbreviated as S101). The laser driver 111 outputs a non-illustrated control signal to cause the semiconductor laser 421 to perform compulsory illumination of laser light.

The BD1EN signal becomes "H" so that the driver 103 is enabled.

The VDO1EN signal remains "L". Therefore, the driver 101 is disabled, and the output thereof is in the "Hi-Z" condition (S102).

The CPU 207 starts monitoring the BD signal (S103). The flow waits until the scanner motor rotates in a predetermined direction at constant speed (S104).

The recording sheet 35 is fed, and when the recording sheet 35 reaches the pre-registration sensor 408, the DC controller 201-3 transmits a vertical synchronization signal (hereinafter referred to as TOP signal) to the video controller 440-3 (S105).

The video controller 440-3 and the DC controller 201-3 start a BD counter, namely a sub-scanning counter (S106).

Then, the flow waits until the BD counter reaches a sub-scanning image area (S107).

When the sub-scanning image area is encountered and the BD1 signal becomes "L" (S108), the video controller 440-3 starts an image clock counter, namely a main-scanning counter (S109).

The DC controller 201-3 stops the compulsory illumination of laser light (S110).

Then, the BD1 signal becomes "H" (S111). The DC controller 201-3 changes the state of the BD1EN signal to "L" to disable the driver 103.

The video controller 440-3 changes the state of the VDO1EN to "H" to enable the driver 101. To prevent unnecessary illumination of laser light, the VDO1 signal is changed to "L" outside the image area (S112).

When the main-scanning image area is encountered (S113), the video controller 440-3 transmits the image signal VDO1. When the main-scanning image area is finished (S115), the DC controller 201-3 makes a determination as to whether or not the sub-scanning image area is finished (S117).

If not finished, the DC controller 201-3 causes the semiconductor laser 421 to perform compulsory illumination of laser light for subsequent main-scanning and changes the state of the BD1EN signal to "H". The video controller 440-3 changes the state of the VDO1EN signal to "L" (S116).

Then, the flow waits until the BD signal becomes "L" (S108).

When it is determined in S117 that the sub-scanning image area is finished, the DC controller 201-3 stops the scanner motor (S118).

The video controller 440-3 changes the state of the VDO1EN to "L" and the DC controller 201-3 changes the state of the BD1EN signal to "L".

Even when the BD1EN and VDO1EN signals become "H" at the same time so the drivers 101 and 103 output opposite logic values, since the impedance matching resistors 131, 132, 135, and 136 function as current-limiting resistors, there will be no problems.

As described above, owing to the circuit construction and operation according to the present embodiment, although each of the connectors 209 and 210 occupies one pin for each color and the FFC 211 occupies one pin for each color (a total of four signal lines for each color), the number of pins of the connector compliant with the expensive DIN standards (IEC603-2/DIN41612) used for the connectors 151 and 152 can be decreased by four lines. Since the connectors 151 and 152 are compliant with the DIN standards, they are expensive compared with the connectors 209 and 210.

During times other than when the typical bidirectional communication is performed, the differential signal line (VD1BD1, /VD1BD1) is sometimes in the "Hi-Z" condition. Although in such times, the laser may emit laser beams erroneously when noise is introduced, in the present embodiment, such erroneous illumination of laser light can be prevented by making sure that the differential signal line is not in the "Hi-Z" condition at least in the image area.

The description of the "color laser printer" according to the fourth embodiment will be provided below. The constructions illustrated in FIGS. 2 and 3 described in connection with the first embodiment are applied to the present embodiment. Therefore, the detailed description of the redundant constructions will be omitted.

The same constructions as those of the related art and the first to third embodiments will be denoted by the same reference numerals, and thus the redundant description thereof will be omitted.

Figure 11:
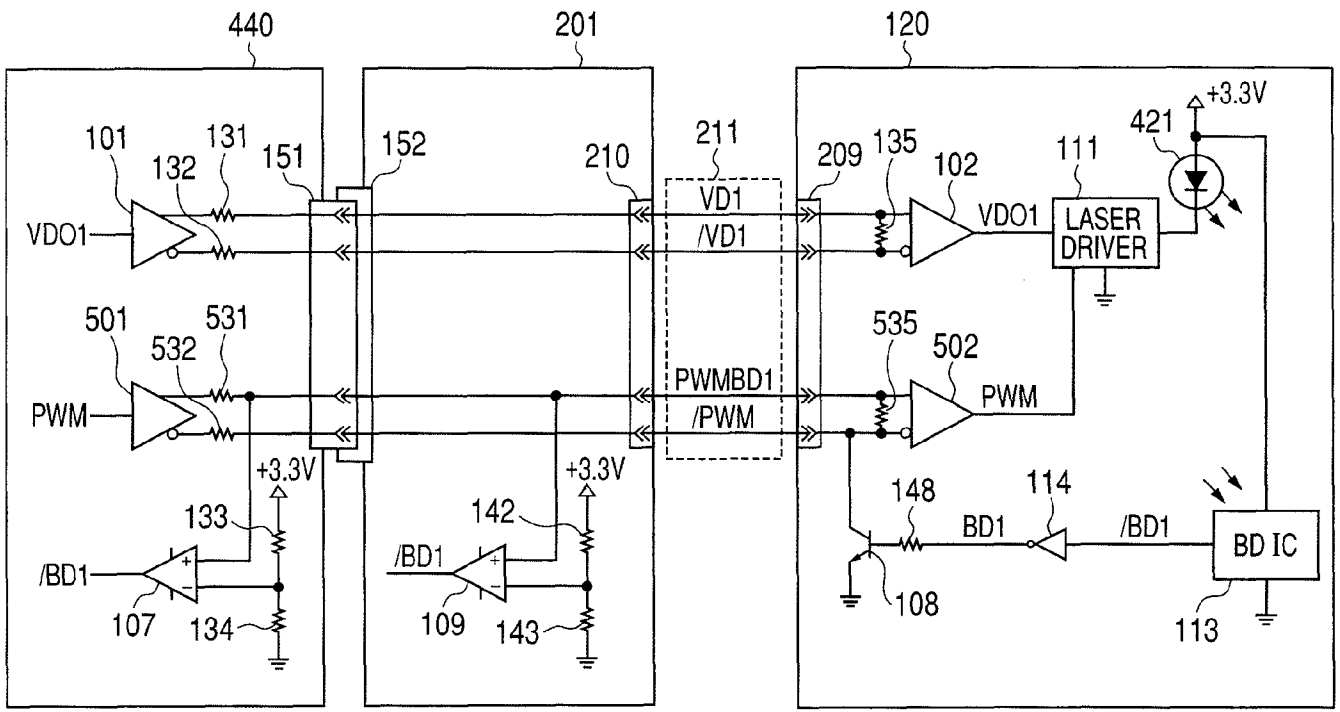
FIG. 11 illustrates another embodiment of the circuit diagram of the input/output interface between the laser illumination signal (image signal) and the horizontal synchronization signal (BD signal).

FIG. 11 is a circuit diagram of an input/output interface between a laser illumination signal (image signal), a control signal (PWM signal), and a horizontal synchronization signal (BD signal) according to the present embodiment.

The circuit diagram of FIG. 11 is different from that of the first embodiment, in that the signal line of the laser illumination signal (image signal) is not used in common with the signal line of the horizontal synchronization signal (BD signal), but the signal line of a control signal (pulse width modulation signal; hereinafter referred to as PWM signal) is used in common with the signal line of the horizontal synchronization signal (BD signal). The control signal (PWM signal) is a pulse signal that determines the illumination intensity of the semiconductor laser 421.

The circuit construction illustrated in FIG. 11 additionally includes a driver 501 that differentially outputs a PWM differential signal (PWMBD1, /PWM), output impedance matching resistors 531 and 532, an input impedance resistor 535, and a receiver 502 that receives the PWM signal. Since the BD signal is communicated through the PWMBD1 line, the collector of the transistor 108 is connected to the PWMBD1 line. The positive terminals of the comparators 109 and 107 for inputting the BD signal are connected to the PWMBD1 line.

When the BD signal /BD1 is input, the output of the inverter 114 becomes "H" and the transistor 108 is turned ON, whereby the voltage on the signal line transmitting the horizontal synchronization signal is changed to a predetermined value. Specifically, the voltage on the PWMBD1 line is changed from 0.77 V or higher to 0.3 V or lower.

Such a construction enables transmission of the BD signal by sharing the PWM signal line.

Figure 12:
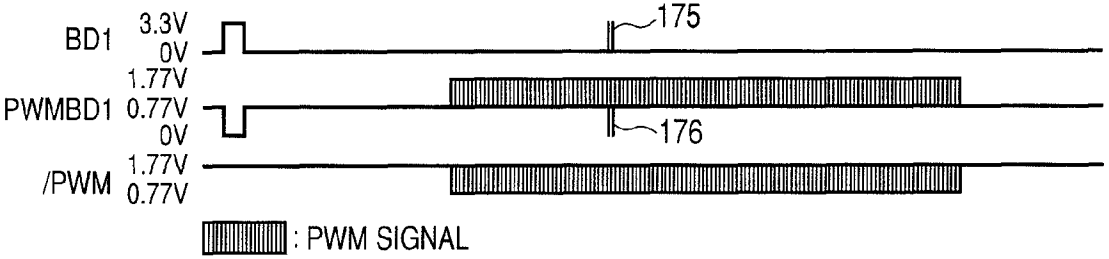
FIG. 12 illustrates another embodiment of the timing chart illustrating the relationship between the image signal and the BD signal.

The state when extraneous noise is superimposed in the present embodiment is depicted by reference numerals 175 and 176 in FIG. 12. In this case, although the duty cycle of the PWM signal may decrease due to the noise 176, since in that case, the illumination intensity will decrease, the same advantages as those of the first and second embodiments can be obtained.

Although the relationship between the positive/negative logic states of the BD signal and the PWM signal are described as being similar to the relationship between the positive/negative logic states of the BD signal and the image signal in the first embodiment, the logic state relationship is not limited to this. The relationship between the positive/negative logic states of the BD signal and the PWM signal may be the same as the relationship between the positive/negative logic states of the BD signal and the image signal in the second embodiment.

The description of the "color laser printer" according to the fifth embodiment will be provided below.

As described above in connection with FIG. 3, the first to fourth embodiments have been described by way of the example of the scanning optical unit in which the polygon mirror is rotated by the scanner motor so that the semiconductor laser performs scanning. However, the present invention can be applied to an image forming apparatus having an exposure system that performs main-scanning by causing a light beam to reciprocate in the main-scanning direction using a deflecting mirror surface (MEMS). That is, the scanning optical unit used in the first to fourth embodiments may be replaced with the scanning optical unit that causes the laser beam to reciprocate in the main-scanning direction using the deflecting mirror surface.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-296929, filed Nov. 20, 2008 which is hereby incorporated by reference herein in its entirety.

What is claimed is:

1. An image forming apparatus comprising:

a laser driver unit that makes an illumination element emit a laser beam according to an input image signal;

a controller unit that controls said laser driver unit; and a plurality of signal lines that connect the laser driver unit and the controller unit to each other so that an image signal converted into a differential signal or a control signal converted into a differential signal is output from the controller unit to the laser driver unit via the plurality of signal lines, wherein said laser driver unit includes:

a laser beam detector that detects a laser beam emitted from the illumination element; and a horizontal synchronization signal generator that generates a horizontal synchronization signal as a single-ended signal which is electrically transmitted to the controller unit via any one of the plurality of signal lines and used as a reference of an image writing timing in response to detection of the laser beam detector, wherein said one of the plurality of signal lines is a common signal line used for electrically transmitting a part of the converted image signal or the converted control signal and for electrically transmitting the horizontal synchronization signal as a single-ended signal.

2. An image forming apparatus according to claim 1, wherein in the common signal line, a voltage value of the image signal or the control signal shifts to a second voltage value defined based on a first voltage value and a voltage value of the horizontal synchronization signal shifts to a third voltage value defined based on the first voltage value, wherein in a case where the second voltage value is larger than the first voltage value, the third voltage value is less than the first voltage value, or in a case where the second voltage value is less than the first voltage value, the third voltage value is larger than the first voltage value.

3. An image forming apparatus according to claim 2, wherein in the common signal line, the image signal being transmitted through the common signal line is erased when the horizontal synchronization signal is transmitted through the common signal line during the transmission of the image signal.

4. An image forming apparatus according to claim 1, wherein in the common signal line, the image signal and the horizontal synchronization signal are not transmitted at a same time.

5. An image forming apparatus according to claim 1, wherein an impedance matching resistor for matching impedances of an image signal output portion that differentially outputs the image signal, a signal line for transmitting the image signal, and an input portion that inputs the image signal is provided between the image signal output portion and the common signal line.

6. An image forming apparatus according to claim 1, wherein during the times when the horizontal synchronization signal is transmitted, a signal source of the horizontal synchronization signal changes a voltage on the signal line for transmitting the horizontal synchronization signal to a predetermined value; and, during the times when the horizontal synchronization signal is not transmitted, the signal source of the horizontal synchronization signal changes the impedance of the signal line for transmitting the horizontal synchronization signal to high impedance.

7. An image forming apparatus according to claim 1, wherein the controller unit includes a first controller unit that supplies the image signal to a printer engine and a second controller unit that controls the printer engine.

8. An image forming apparatus according to claim 1, wherein the horizontal synchronization signal is transmitted in a direction from the laser driver unit to the controller unit, and the image signal or the control signal is transmitted from the controller unit to the laser driver unit.

* * * * *